US005431612A

United States Patent [19]

Holden

[11] Patent Number: 5,431,612

[45] Date of Patent: Jul. 11, 1995

[54] TREADMILL EXERCISE APPARATUS WITH ONE-WAY CLUTCH

[75] Inventor: Edward R. Holden, Prior Lake, Minn.

[73] Assignee: NordicTrack, Inc., Chaska, Minn.

[21] Appl. No.: 265,422

[22] Filed: Jun. 24, 1994

[51] Int. Cl.[6] ..... A63B 23/06

[52] U.S. Cl. ..... 482/54

[58] Field of Search ..... 482/54, 57, 148; 198/832

[56] References Cited

U.S. PATENT DOCUMENTS

| | | | |
|---|---|---|---|
| 3,711,812 | 1/1973 | Cherry . | |
| 3,731,917 | 5/1973 | Townsend . | |
| 3,737,163 | 6/1973 | Sumrall | 482/54 |
| 4,664,646 | 5/1987 | Rorabaugh | 482/54 |
| 4,749,181 | 6/1988 | Pittaway et al. . | |
| 4,865,313 | 9/1989 | Kuo | 482/54 |
| 4,928,956 | 5/1990 | Chen | 482/54 |
| 4,944,713 | 7/1990 | Salerno | 482/54 |
| 5,102,380 | 4/1992 | Jacobson et al. | 482/54 |

OTHER PUBLICATIONS

NordicTrack Walkfit TM brochure, No. B-144, 1994.

*Primary Examiner*—Richard J. Apley
*Assistant Examiner*—Lynne A. Reichard
*Attorney, Agent, or Firm*—Merchant & Gould

[57] ABSTRACT

A motorized treadmill apparatus having a frame including two spaced apart rollers with an endless belt extending around and between the rollers is disclosed. A motor is operatively connected to the belt via a one-way clutch device such that the belt is allowed to move at a speed greater than the speed that the motor is driving the belt. However, the one-way clutch device constrains the belt to move at a speed at least equal to the speed that the motor is driving the belt. Optionally, an inertia device (e.g., a flywheel) may be attached to the belt to help maintain the speed of the belt at the pace which the user sets. This is especially useful when the user is moving the belt at a speed greater than the speed that the motor is driving the belt. In order to slow the belt back to the speed at which the motor is driving the belt, and to increase the resistance to the user, a friction device (such as a belt and a friction member) may be utilized.

17 Claims, 4 Drawing Sheets

TREADMILL EXERCISE APPARATUS WITH ONE-WAY CLUTCH

FIELD OF THE INVENTION

The invention is directed to an exercise apparatus, and more particularly is directed to a motorized treadmill apparatus having a one-way clutch device between the motor and the belt, thereby allowing the belt to move at speeds faster than the motor drives the belt.

BACKGROUND OF THE INVENTION

Physical fitness and conditioning have become increasingly popular in today's health conscious society. This has resulted in the development of several different types of exercise devices. One of these devices is the treadmill, which has become popular for providing an indoors workout of running, jogging or walking. Treadmills have been installed in a variety of workout environments including health clubs and homes.

It is known in the art to provide a treadmill with either a motorized or non-motorized tread or belt. Examples of previous treadmills include the devices disclosed in U.S. Pat. Nos. 4,749,181 (issued to Pittaway); 3,731,917 (issued to Townsend); and 3,711,812, issued to Cherry. Each of these patents generally discloses motorized belt treadmills having motors to drive the belts at fixed speeds. Such devices, however, have drawbacks associated with requiring the user to maintain an exact pace with the motor or else requiring the user to constantly adjust the speed of the motor. This can be frustrating, can diminish the user's perception of the quality of the workout, or can frustrate the user so that the user does not want to utilize the treadmill. Additionally, the user may feel that the workout is "jarring" if the user has a slightly different pace than the belt speed (e.g., the belt forces the user to rapidly adjust the pace as the user's feet contact the belt).

It is also known in the art to provide non-motorized treadmills. One example of a non-motorized treadmill is manufactured by NordicTrack, Inc., of Chaska, Minn. (the assignee of the present invention) under the model designation WALKFIT. Non-motorized treadmills allow users to vary their pace, avoid jerky starts and stops, and eliminate the motors and electronics for controlling the speed of the belt. However, since the user provides the power to keep the belt moving, inertial devices and/or brakes are generally required to help maintain the speed of the belt. Also, non-motorized treadmills do not allow for paced workouts and may not approximate the sense of running, jogging or walking on ground as realistically as motorized treadmills—since the user must power the belt.

Therefore, a need exists in the art for a motorized treadmill device for assisting in maintaining a treadmill belt moving at a predetermined speed, while allowing the user to exceed the predetermined speed. A need also exists for such a device which further provides for controlling the excess force imparted on the belt by the user when exceeding the predetermined speed.

SUMMARY OF THE INVENTION

The present invention addresses these and other problems in the prior art by providing a motorized treadmill device which automatically allows for variations in the user's pace by providing a means between the motor and the belt which constrains the belt to move at a speed at least equal to a set speed, but allows the belt to move at a speed faster than the set speed. Devices consistent with the invention preferably utilize a frame having two spaced apart rollers with an endless belt extending around and between the rollers. A motor is operatively connected to the belt via a one-way clutch device such that the belt is allowed to move at a speed greater than the speed that the motor is driving the belt. However, the one-way clutch device constrains the belt to move at a speed at least equal to the speed that the motor is driving the belt.

As an option, an inertia device (e.g., a flywheel) may be attached to the belt to help maintain the speed of the belt at the pace which the user sets. This is especially useful when the user is moving the belt at a speed greater than the speed that the motor is driving the belt. Also, in order to slow the belt back to the speed at which the motor is driving the belt, and to increase the resistance to the user, a friction device (such as a belt sliding and a friction member) may be utilized.

Therefore, according to one aspect of the invention, there is provided a treadmill apparatus, comprising: a motor for driving an endless belt operatively located around and between two opposing roller members; and a one-way clutch device operatively connecting said motor to said belt, wherein said belt can move at speeds greater than the motor is driving the belt.

According to another aspect of the invention, there is provided an exercise treadmill, comprising: a frame; a tread rotatably mounted to said frame; a motor mounted to said frame, wherein said motor rotates a shaft; and a connecting means for connecting said shaft to said tread in such a manner that said tread must rotate at least as fast as said shaft, and said tread is free to rotate faster than said shaft.

These and other advantages and features which characterize the invention are pointed out with particularity in the claims attached hereto and forming a further part hereof. However, for a better understanding of the invention, and the advantages attained through its use, reference should be made to the Drawing and to the accompanying descriptive matter in which there is described preferred and alternative embodiments of the invention.

DETAILED DESCRIPTION OF THE PREFERRED EMBODIMENT

Figure 2:
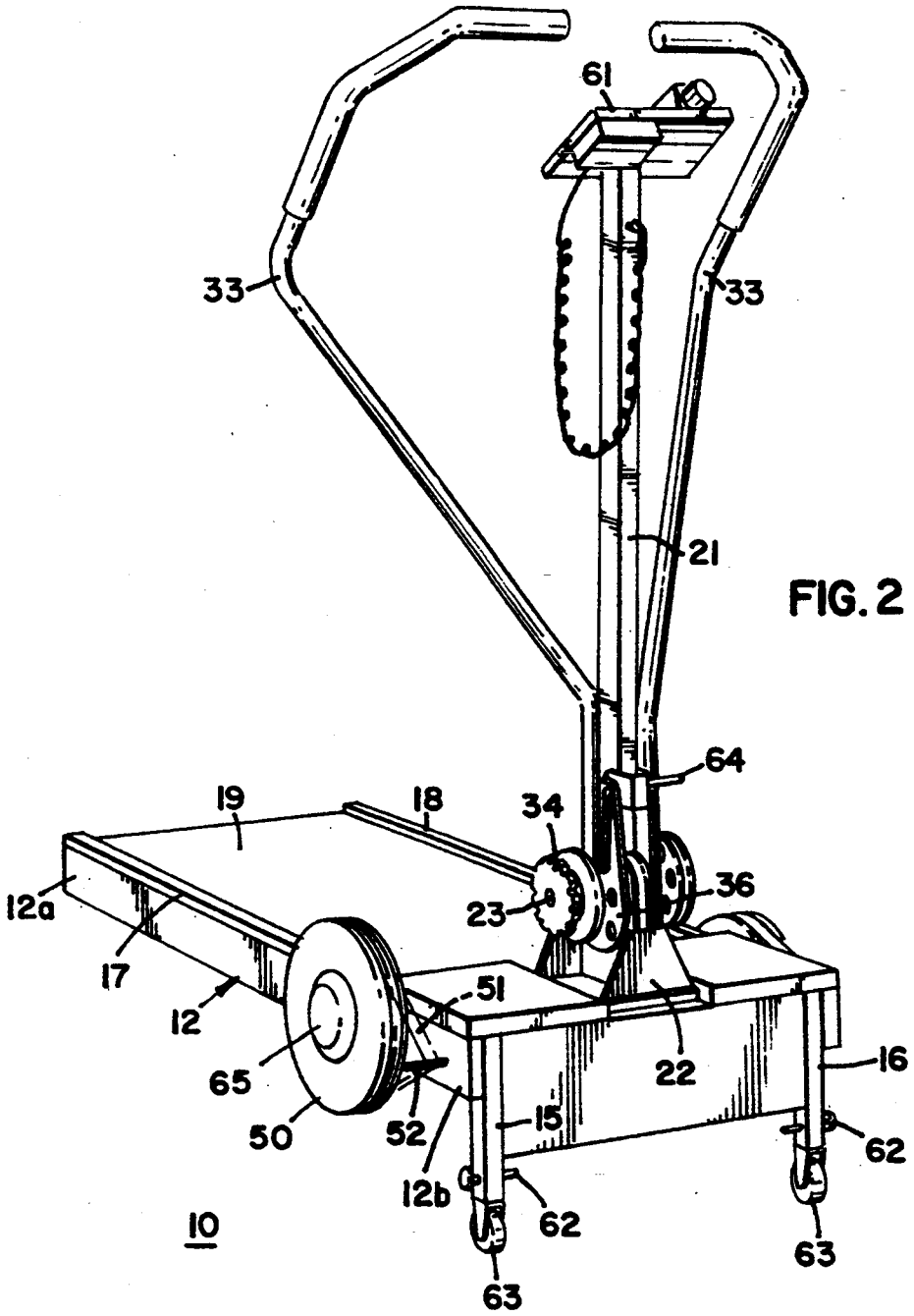
FIG. 2 is a perspective view of a preferred treadmill apparatus 10 constructed in accordance with the principles of the present invention.
Figure 3:
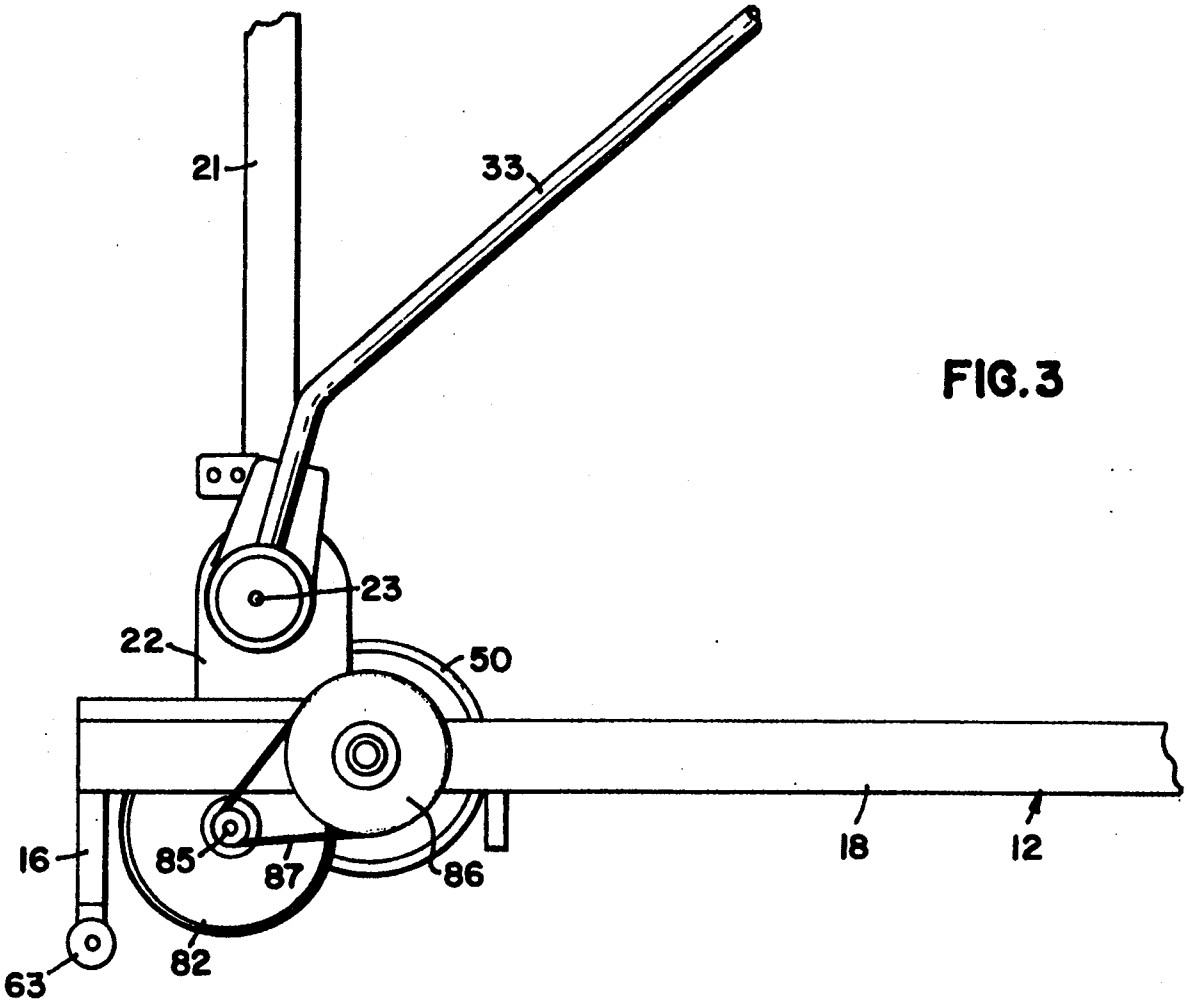
FIG. 3 is a side elevational view of the treadmill apparatus 10 of FIG. 2.

Turning now to the Drawing, wherein like numbers denote like parts throughout the several views, FIGS. 2 and 3 show an exercising apparatus constructed according to the principles of the present invention. The treadmill apparatus is generally designated by the reference numeral 10. The apparatus 10 includes a substantially planar base portion 12 having a rear end **12*a* supported by pads (not shown) on the underside of the base portion 12 and a front end 12***b* supported by leg supports 15 and 16. The relative sizes and locations of the pads and the leg supports 15 and 16 are such that the base 12 is supported in an uphill orientation relative to a floor surface on which the pads and leg supports 15, 16 rest.

Figure 1:
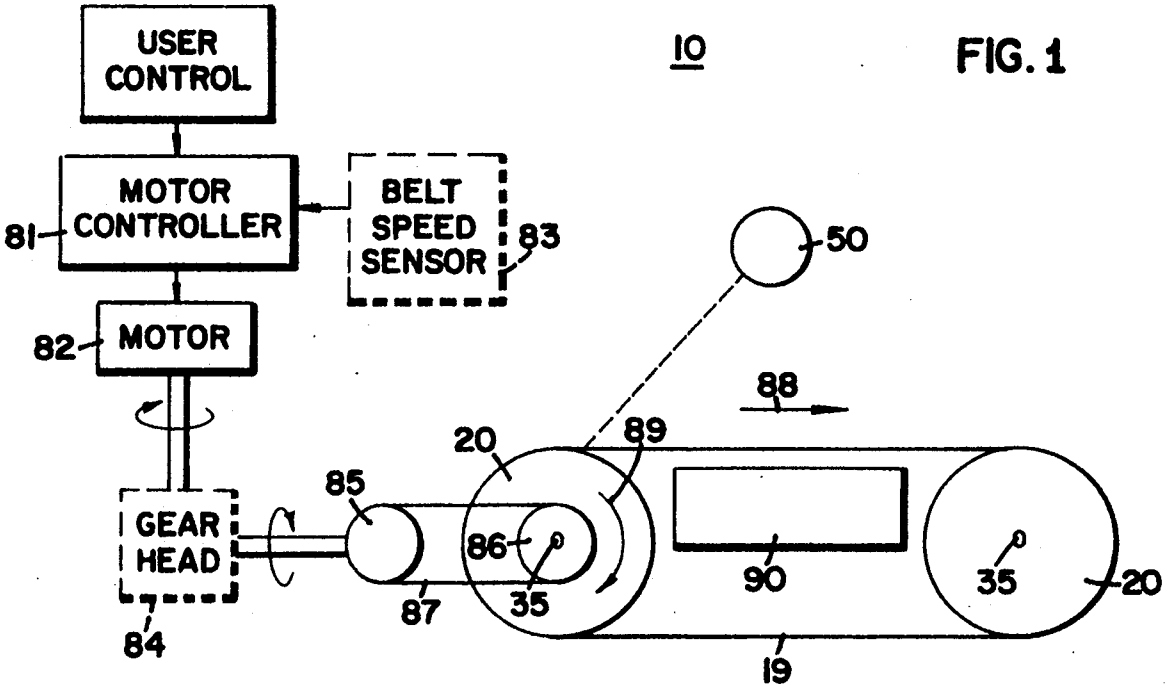
FIG. 1 is a diagrammatic illustration (with functional blocks) of a preferred embodiment treadmill apparatus 10 constructed according to the principles of the present invention.

The base 12 includes side members 17 and 18 which extend substantially from the front 12*b* to the rear 12*a* of the base 12. A tread 19 is disposed between the front 12*b* and rear 12*a* ends of the base 12 and between the side members 17 and 18. Thus, the tread 19 may be said to be disposed within the dimensions or plan form of the base 12. The tread 19 is an endless belt preferably constructed of a continuous loop of resilient material that is supported by a first roller member 20 proximate the rear 12*a* of the base 12 and by a second roller member 20 the front 12*b* of the base 12. The roller members 20 are mounted on axles or shafts 35 (having suitable bearings or bushings between the axles 35 and frame 12) and are best seen in FIG. 1.

A low friction platform 90 (best seen in FIG. 1) is secured to the upwardly facing portion of the base 12 and extends substantially between the roller members 20 and beneath the tread 19. The platform 90 provides support for an upwardly facing portion of the tread 19 and any user on the tread 19.

Tread 19 is rotatably mounted around and between the rotatable members 20 (e.g., the tread 19 rotates relative to the base 12 and cooperates therewith to function as a treadmill for a user wishing to engage in walking and/or running exercises). As the user walks or runs on the treadmill, the upper surface of the tread 19 moves rearward while the person may remain substantially in place relative to the length of the base 12. Arrow 88 illustrates the direction of movement of the tread 19, while the arrow designated as 89 illustrates the direction of rotation of the shaft 35.

In the preferred embodiment, a stanchion or pedestal 22 extends upward from a forward portion of the base 12. A support member 21 extends upward from an upper portion of the pedestal 22. Also mounted to pedestal 22 are arm exercise handles 33. A pelvis engaging pad (not shown) may be mounted on the support member 21 for persons who may require assistance in maintaining their balance and position on the treadmill apparatus 10. Support member 21 is pivotably secured to the pedestal 22 and may be secured in any one of several orientations about hub 23. The user exercising on the treadmill apparatus 10 may grasp any of the handles 33 and/or rest his or her pelvis against the pad to the extent necessary or desirable.

The handles 33 utilize a system of plates and tensioning devices to provide an optional upper body workout while using the treadmill apparatus 10. Knurled knob 34 acts as the tensioning device against the friction plate 36 to increase the effort needed to move the handles 33 forward and backward.

Still referring to FIGS. 2 and 3, a fly wheel 50 is mounted on axle 35 (best seen in FIG. 1). The front roller 20 that supports the tread 19 is also mounted on axle 35, and the fly wheel 50 rotates contemporaneously with the tread 19. Optional drag strap 51 (illustrated in phantom in FIG. 2) is disposed about a circumferential portion of the fly wheel 50 and resistance member 52. The drag strap 51 interacts with these members to provide resistance to the tread 19 movement. Resistance member 52 is operatively connected to a lever assembly (not shown) in such a manner that movement of the lever assembly 54 alters the tension in the drag strap 51, thereby altering the resistance to treadmill movement. It will be appreciated that the drag strap 51 may preferably be optionally engaged and disengaged so as to not provide an undue drag on the motor 82.

A cable (not shown) is operatively connected to the lever assembly and extends to a user manipulated knob preferably mounted on the user control panel 61 mounted on an upper portion of the support member 22. A user wishing to adjust the resistance to tread 19 movement simply turns the knob to adjust the tension in the drag strap 51. Exercise parameters may also be conveniently displayed on indicators mounted on the user control panel 61. The parameters may include work performed, a time measurement, and/or energy expended and may be derived from measured tension in the drag strap among other measurements.

Adjustment pins 62 may be provided in leg supports 15 and 16 to vary the length of the leg supports 15 and 16. By adjusting the length, the elevation of the treadmill apparatus 10 is increased or decreased to effect the difficulty of the workout. Further, wheels 63 may be provided on leg supports 15 and 16 to enable easy movement of the apparatus 10. Still further, in order to fold the apparatus to a smaller size, the support member 21 may be folded down by removal of a locking pin 64.

Cover plate 65 and other trim items may be used on the flywheel 50 and other exposed elements to enhance the appearance of the device. The structural components of frame 12 are preferably constructed of wood, which provides an aesthetically pleasing appearance that fits well with many decors. Consequently, device 10 does not necessarily need to be stored in a closet or unused room when it is not in use. Other materials, such as different metals, plastics or composite materials, or combinations thereof, may be used to form the structural components of frame 12. Further, the structural members may be painted or covered with decorative films to improve the appearance of treadmill apparatus 10. Pedestal 22, support member 22 and handles 33 are preferably constructed of a metal such as stainless steel. However, it will be appreciated that other materials having the required strength might also be used.

Additionally, bumper guards or trim (not shown) formed of rubber, plastic or another non-skid material may also be used along the edges of the structural members. The use of bumper guards or other trim prevents the device from sliding and/or marring the floor on which the apparatus is placed during use and other items which the apparatus may contact when stored. Further, the guards or trim improve the decorative appearance of apparatus 10 and may protect a user's hands from sharp edges, as well as splinters if wood structural members are used.

Turning now to FIG. 1, the functional elements of the apparatus 10 are illustrated. The user control block 80 provides user input from the various controls on the user control panel 61 (best seen in FIGS. 2 and 4) to the motor controller block 81. Motor controller block 81 is operatively connected to the motor 82 and includes the necessary electronics to maintain motor 82 at a preset speed. The motor controller block 81 also varies the speed of the motor 82 in accordance with the user input from user control block 80. Those skilled in the art will appreciate that the terms "set speed" or "preset speed" as used herein may be defined as several speeds which are stored in a memory location in the motor controller block 81, several speeds at which the motor can run, or the contemporaneous speed which the user sets.

It will also be appreciated by those skilled in the art that the motor controller block 81 may include a servomotor control device and may use feedback loop information from an optional belt speed sensor 83, or a voltage tachometer or optical tachometer from the motor 82. Alternatively, motor 82 can be a stepper motor or an a.c. motor. Constant speed motors might also be utilized and the speed can be adjusted through variable transmissions or gear head block 84. It will also be appreciated that such transmissions or gear heads can be used with variable speed motors to vary the required output torques of the motors, among other factors. Therefore, motor controller block 81 may be varied in accordance with the type of prime mover system utilized to drive the tread 19, wherein the prime mover system includes the motor and any required or optional gearing and/or transmission.

Motor 82 is operatively attached to pulley 85, either directly or through optional gear head block 84, to impart rotation to the rollers 20 via pulley belt 87. Pulley belt 87 may be either a chain, belt, or other known device. Pulley belt 87 is preferably selected to reduce slippage of the belt on the pulley 85 and the outer circumference of one-way clutch device 86. It will also be appreciated that the motor 82 may be directly connected to the rollers 20.

One-way clutch device 86 is operatively mounted on the axle 35 of the front roller 20. However, the functionality of one-way clutch device 86 may also be provided through optional gear head block 84 or at pulley 85, or in other ways well known in the art. The one-way clutch device 86 provides a means for allowing the tread 19 to move at a speed greater than the preset speed of the motor 82, while constraining the tread 19 to move at a speed at least equal to the preset speed. Therefore, those skilled in the art will appreciate that other devices such as ratchet mechanisms and other pawl-type mechanisms might also be used to provide this functionality.

Optional fly wheel 50 is illustrated by phantom line in FIG. 1 as being operatively attached to roller axle 35.

In operation, a user may utilize the treadmill apparatus 10 in either a motorized or non-motorized manner. Using the apparatus in a motorized manner, the user steps onto the treadmill tread 19 and begins to walk, jog and/or run. The user may then adjust the speed controls located on the control panel 61 to a preset speed. Since the tread 19 can move at speeds greater than the preset speed, due to the one-way clutch device 86, the user can exceed the pace set by the preset speed. In any event, the tread 19 will move in the direction illustrated by the arrow designated 88 in FIG. 1. It will be appreciated by those skilled in the art that the motor controller block 81 may provide for a ramping of the speed up to or down to the preset speed in order to allow a user to become accustomed to the preset speed and avoid jerky starts and stops.

Once the motor 82 is moving the tread/belt 19 at the preset speed, the user does not have to drive the tread 19 and can walk/jog/run on the tread 19 at either the preset speed or at the user's own pace without jarring. In the event that the user moves at a pace greater than the preset speed, energy is imparted to the tread 19 to drive the tread 19 at a speed greater than the preset speed. However, the one-way clutch device 86 allows movement of the tread 19 at the greater speed and, optionally, the excessive force is also imparted to the fly wheel 50 to smooth the overall speed of the tread 19.

The one-way clutch device 86 also allows the user to workout on the treadmill apparatus 10 in a non-motorized manner. In this mode, the user steps onto the treadmill tread 19 and begins to walk, jog and/or run. Since the tread 19 can move at speeds greater than the motor 82 is driving the tread (e.g., in the present case the motor is "driving" the tread 19 at a speed of zero), due to the one-way clutch device 86, the user can exceed the pace set by the preset speed. The tread 19 moves in the direction illustrated by the arrow designated 88 in FIG. 1. Energy imparted to the tread 19 by the user drives the tread 19 and, optionally, force is also imparted to the fly wheel 50 to smooth the overall speed of the tread 19.

ALTERNATIVE EMBODIMENT

Figure 4:
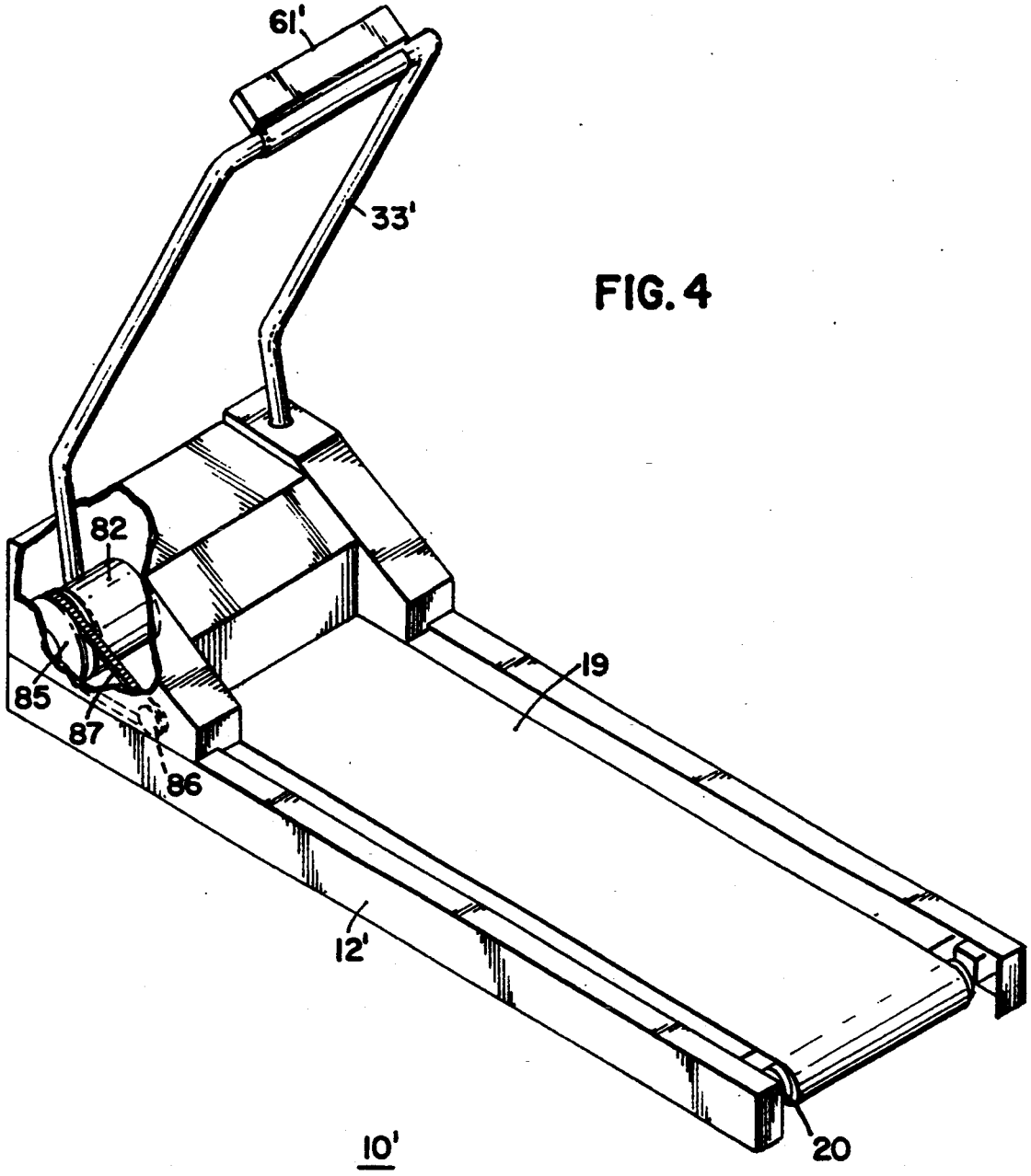
FIG. 4 is a perspective view of an alternative embodiment treadmill apparatus 10' constructed in accordance with the principles of the present invention.

Next referring to FIG. 4, there is illustrated an alternative embodiment apparatus 10' utilizing a rail 33' rather than handles 33 (as included in the preferred apparatus 10 illustrated in FIGS. 2 and 3). User control panel 61' is cooperatively mounted on the rail 33'.

The alternative embodiment 10' includes a tread 19 which is located within frame 12 and extends around and between rollers 20. Motor 82, pulley 85, belt 87, and one-way clutch device 86 are also illustrated. It will be appreciated by those skilled in the art that the other elements described above in connection with the preferred embodiment of the present invention may also be utilized in connection with the alternative embodiment 10'.

It will be appreciated that even though numerous characteristics and advantages of the present invention have been set forth in the foregoing description, together with details of the structure and function of the invention, the disclosure is illustrative only and changes may be made in detail without departing from the spirit and scope of the invention. Other alterations and modifications are well within the knowledge of those skilled in the art, and are to be included within the broad scope of the appended claims.

We claim:

1. A treadmill apparatus, comprising:

a) a prime mover for driving an endless belt operatively located around and between two opposing roller members; and b) means for operatively connecting said prime mover to said belt, wherein said connecting means allow said belt to move at speeds greater than said prime mover is driving said belt and constrain said belt to move at a speed which is at least as fast as the speed at which said prime mover is driving said belt.

2. The treadmill apparatus of claim 1, wherein said connecting means includes a one-way clutch.

3. The treadmill apparatus of claim 1, wherein said prime mover includes a motor.

4. The treadmill apparatus of claim 3, wherein said prime mover further includes a gear head.

5. The treadmill apparatus of claim 1, further including a flywheel operatively connected to one of said rollers.

6. The treadmill apparatus of claim 5, further including a drag strap and a friction member, and wherein said drag strap is operatively connected to the periphery of said flywheel and to said friction member.

7. The treadmill apparatus of claim 5, wherein said connecting means and said flywheel device are operatively connected to the same one of said rollers.

8. The treadmill apparatus of claim 1, wherein said connecting means includes a one-way clutch and said prime mover includes a motor.

9. The treadmill apparatus of claim 8, further including a flywheel operatively connected to one of said rollers.

10. An exercise treadmill, comprising:

a frame;

a tread rotatably mounted to said frame;

a motor mounted to said frame, wherein said motor rotates a shaft; and a connecting means for connecting said shaft to said tread in such a manner that said tread must rotate at least as fast as said shaft, and said tread is free to rotate faster than said shaft.

11. An exercise treadmill according to claim 10, wherein said connecting means includes a one-way clutch.

12. An exercise treadmill according to claim 10, wherein said tread is supported by a forward roller and a rearward roller, and said connecting means includes a one-way clutch mounted on said forward roller.

13. An exercise treadmill according to claim 12, wherein said connecting means further includes a continuous belt that links said shaft to said one-way clutch.

14. An exercise treadmill according to claim 12, further comprising a flywheel mounted on said forward roller.

15. An exercise treadmill according to claim 14, further comprising a drag strap disposed about a circumferential contact surface on said flywheel.

16. A method of driving a belt of an exercise treadmill, of the type including a frame, a tread rotatably mounted to said frame, and a motor mounted to said frame, wherein said motor rotates a shaft, comprising the step of: connecting said shaft to said tread in such a manner that said tread must rotate at least as fast as said shaft, and said tread is free to rotate faster than said shaft.

17. The method of claim 16, further comprising the step of establishing and maintaining a preset speed at which said motor rotates said shaft.

* * * * *